United States Patent [19]

Akiyama et al.

[11] 4,187,343

[45] Feb. 5, 1980

[54] PROCESS FOR PRODUCING NON-WOVEN FABRIC

[75] Inventors: Takashi Akiyama; Akinori Tanji; Seiichi Asano, all of Otsu, Japan

[73] Assignee: Toyobo Co., Ltd., Osaka, Japan

[21] Appl. No.: 730,983

[22] Filed: Oct. 8, 1976

[30] Foreign Application Priority Data

Oct. 8, 1975 [JP] Japan ..... 50-122259

[51] Int. Cl.[2] ..... B67D 5/60

[52] U.S. Cl. ..... 428/288; 428/224; 264/119; 264/163; 264/248; 264/288.8; 28/170; 28/171

[58] Field of Search ..... 264/154, 288, 248, 119, 264/103, 210 F, 210 R; 428/288, 137, 224

[56] References Cited

U.S. PATENT DOCUMENTS

| | | | |
|---|---|---|---|
| T857 | 12/1968 | Zeisberg | 264/154 |
| 3,377,232 | 4/1968 | Meacock et al. | 428/224 |
| 3,772,872 | 11/1973 | Piazza et al. | 57/140 R |
| 3,855,046 | 12/1974 | Hausen et al. | 428/288 |
| 3,882,063 | 5/1975 | Gouw | 264/119 |
| 3,912,567 | 10/1975 | Schwartz | 428/288 |
| 3,936,999 | 2/1976 | Ikeda et al. | 57/157 TS |
| 3,949,111 | 4/1976 | Pelletier | 428/288 |
| 3,949,127 | 4/1976 | Ostermeier et al. | 428/137 |
| 3,949,128 | 4/1976 | Ostermeier | 428/224 |
| 3,959,054 | 5/1976 | Pietsch et al. | 428/288 |
| 4,005,169 | 1/1977 | Cumbers | 264/103 |
| 4,048,364 | 9/1977 | Harding et al. | 428/288 |

*Primary Examiner*—Jay H. Woo

*Attorney, Agent, or Firm*—Birch, Stewart, Kolasch & Birch

[57] ABSTRACT

A process for producing a non-woven fabric having excellent draping properties and strength and further having a handling similar to that of woven fabrics, which comprises drawing uniaxially or biaxially a non-woven sheet material comprising not less than 90% by weight of semi-drawn fibers of a linear high molecular weight compound (e.g. polyesters) having a breaking elongation of 80 to 150% wherein the fibers of said sheet material are crossed and intertwined with each other and are partially bonded at the crossing points, said drawing being carried out until the bonding of the fibers is partially broken or the fibers are partially cut.

5 Claims, No Drawings

PROCESS FOR PRODUCING NON-WOVEN FABRIC

The present invention relates to a process for producing a non-woven fabric having excellent draping properties and strength and having a handling similar to that of woven fabrics. More particularly, it relates to a process for producing a non-woven fabric by drawing uniaxially or biaxially a non-woven sheet material comprising not less than 90% by weight of semi-drawn fibers of a linear, high molecular weight compound having a breaking elongation of 80 to 150% wherein the fibers are crossed and intertwined with each other and are partially bonded at the crossing points, said drawing being carried out or continued until the bonding of the fibers is partially broken or the fibers are partially cut.

Generally, non-woven fabrics have advantages to the woven fabrics in the economical viewpoint and in the productivity, and it has been expected or found advantageous to use the non-woven fabric as the substitute material of the woven fabrics for clothes. However, the non-woven fabrics have hardly been used for clothes because of inferior draping properties of the non-woven fabrics.

The draping properties of the non-woven fabrics are incompatible with the strength of the fabrics, and when one of the properties is increased, the other is decreased, that is, when the strength of the fabrics is increased, the draping properties are decreased. For instance, although it is known that the strength of the non-woven fabric can be increased by increasing the number of the bonding or hanging-up points of the non-woven fabrics or by applying a large amount of a bonding resin to the layer of the fibers, it results in inhibition of the movement of the fibers, an increase of a resistance against the deformation, and a decrease of the draping properties thereof.

For eliminating these defects, there has been proposed a method of mixing binder fibers to the fibers of the non-woven fabrics, thereby controlling the density of the bonded points within crossed points of the fibers, and a method of intertwining the fibers physically by a water jet or the like in a technique of producing the non-woven fabric, wherein no bonding resin is used and therefore the fibers can move with ease.

However, according to the former method, the strength of the fabric can not necessarily be increased, and the draping properties can not be so improved and further the productivity is still low. On the other hand, according to the latter method, there can be obtained a non-woven fabric having properties similar to those of woven fabrics, but a specific apparatus must be used for the water jetting, and further, the productivity is significantly low.

It is generally considered that the breaking strength of the non-woven fabrics is given merely by a part of the bonding points of the fibers, but most of the bonding points of the fibers do not contribute to the breaking strength because they are broken at the first stage of deformation thereof. Most of the bonding points show, rather, a resistance against the deformation and thereby the draping properties are decreased. From this standpoint, the present inventors have tried to improve the draping properties by bonding the non-woven sheet material with a resin and then drawing it to break most of the bonded points but the draping properties have still not been improved.

As a result of the present inventors' intensive studies, it has now been found that the desired non-woven fabric having excellent draping properties and strength and further, a handling similar to that of woven fabrics, can be produced by drawing uniaxially or biaxially a specific non-woven sheet material until the bonding of the fibers, i.e. some of the bonded points of the fibers, are partially broken or the fibers are partially cut.

An object of the present invention is to provide a process for producing a non-woven fabric having excellent draping properties and strength and further having a handling similar to that of woven fabrics.

Another object of the invention is to provide a method for improving the draping properties of the non-woven fabric without decreasing the strength thereof.

A further object of the invention is to provide a process for producing the desired non-woven fabric without using any bonding agent.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description. These changes and modifications are intended to be encompassed within the scope of this invention.

According to the present invention, the desired non-woven fabric having excellent draping properties and strength can be produced by drawing uniaxially or biaxially a non-woven sheet material comprising not less than 90% by weight of semi-drawn fibers of a linear high molecular weight compound having a breaking elongation of 80 to 150% wherein the fibers are crossed and intertwined with each other and are partially bonded at the crossed points (i.e. the proper parts of the crossing points are bonded), said drawing being carried out until the bonding of the fibers is partially broken or the fibers are partially cut.

The non-woven sheet material to be drawn comprises mainly fibers of polyesters, polyamides or polyolefins which are produced by melt-spinning the polymers. Suitable fibers are aromatic polyester fibers, particularly the fibers produced by melt-spinning a polyester obtained from an aromatic dicarboxylic acid (e.g. terephthalic acid, isophthalic acid, or naphthalenedicarboxylic acid) as the acid component and an alkylene glycol (e.g. ethylene glycol, or propylene glycol) as the diol component. Wherein it is preferred that not less than 80% by mol, particularly not less than 95% by mol, of the component unit of the polyester, is an ethylene terephthalate chain. By using such a polyester, there can be obtained a particularly suitable non-woven fabric having balanced draping properties and strength.

The fibers contained in the non-woven sheet material are staple fibers, filaments, or a mixture thereof, and preferred fibers comprises predominantly filaments. These fibers should have a breaking elongation of 80 to 150%. When the fibers have a breaking elongation of more than 150%, the non-woven fabric obtained therefrom shows filmy appearance and has low draping properties. On the other hand, when the breaking elongation is less than 80%, the non-woven fabric has a low strength and is occasionally unable to be drawn.

Moreover, the non-woven sheet material should contain at least 90% by weight of the above polyester fiber on the basis of the whole weight of the sheet material. When the content of the polyester fiber is less than 90% by weight, the non-woven fabric shows remarkable hairiness by the drawing and does not have enough strength.

The non-woven sheet material may be preferably produced by so-called "spun bond method," i.e. by melt-spinning an aromatic polyester, drafting the resulting undrawn filaments by an air-jet type drafting device (generally referred to as "air sucker") at a high speed and collecting the drafted filaments onto a collector which is moving at a constant speed to give a homogeneous sheet material. According to this method, the extension of the fibers contained in the obtained sheet material can be optionally regulated by controlling the drafting speed.

The sheet material thus obtained is usually heat-pressed for bonding partially the fibers at the crossed points thereof, said heat-press being performed on the sheet material wholly or sporadically. That is, the heat-press may usually be performed by calendering with pressing the sheet material at a temperature higher than the second-order transition temperature of the polyester, preferably at a temperature of at least 30° C. higher than the second-order transition temperature of the polyester and at least 60° C. lower than the melting point of the polyester, at a linear pressure of from 20 to 100 kg/cm, wherein the engraving of the calender roll and the method for heating are appropriately selected.

The sheet material thus obtained, which has a handling similar to that of a paper, is then drawn uniaxially or biaxially. The drawing is carried out until the bonding of the fibers is partially broken or the fibers are partially cut, i.e. until the filmy appearance of the sheet material is changed and remarkable whiteness is observed or some filaments are cut, though there may be somewhat of a difference depending on the characteristics of the fibers and the mixed ratio thereof. At this stage, the draw ratio of the fibers is usually about 1.1 to 2.0 times.

The drawing can be carried out with a conventional drawing apparatus used for drawing the conventional films at a temperature higher than the second-order transition temperature of the polyester fiber, preferably at a temperature of at least 10° C. higher than the second-order transition temperature of the polyester fiber and at least 50° C. lower than the melting point of the polyester fiber. When the drawing is carried out at a lower temperature, the draping properties and bulkiness of the resulting non-woven fabric become higher, but on the other hand, the strength of the fabric becomes lower. Accordingly, a suitable temperature may be selected according to the desired utilities of the products.

Before the drawing, an adhesive may be applied to the sheet material for preventing the undesirable hairiness on the surface of the non-woven fabric.

Thus, according to the present invention, the desired non-woven fabrics having excellent draping properties and strength and further having a handling similar to that of woven fabrics, can be easily produced by, simple operations desired. The non-woven fabric of the present invention is useful for clothes and further as a covering material for wires, cables or the like.

The present invention is illustrated by the following Examples, but is not limited thereto. In the Examples, the various properties were determined as follows:

The basis weight: a sample (30.0 cm×33.3 cm) of the product was weighed, from which the basis weight was calculated.

Tensile strength: it was measured with Tensilone (made by Toyo Baldwin Co.), on a sample (width: 1.5 cm, length: 20 cm) in the gripping length by a chuck: 10 cm and at a pulling rate: 20 cm/minute.

Breaking elongation: it is shown by the extension at the maximum loading during the measurement of the tensile strength.

Tearing strength: according to the method defined in JIS L-1004.

Bending length: according to the method defined in JIS L-1005.

Density: the thickness of 20 points of the product which were at random elected was measured by a dial thickness gauge, and the basis weight as mentioned above was divided by the average thickness to give the density of the product.

EXAMPLE 1

According to the spun bond method, i.e. by melt-spinning a thermoplastic high molecular weight compound, drafting the resulting undrawn filaments with an air sucker, blasting the drafted yarns against a conveyor net which is moving at a constant speed to give a web, there was produced a web having the basis weight of 100 g/m$^2$ consisting of filaments of polyethylene terephthalate. The filaments had a breaking elongation of 148% and a strength of 2.1 g/d. The web was heat-pressed with a heated embossing roll having a satin-like patern and a paper roll at a linear pressure of 50 kg/cm, at a speed of 10 m/minute and at a temperature of the surface of the heated embossing roll of 120° C. to give a sheet having a filmy touch.

The sheet thus obtained was drawn in a longitudinal draw ratio of 1.2 times at 90° C. and then in a widthwise draw ratio of 1.2 times at 110° C. by using a film drawing machine, by which the bonded points obtained during the embossing treatment were partially broken. The non-woven sheet material thus obtained had the properties as shown in the following Table 1.

Table 1

| | Basis weight (g/m$^2$) | Tensile strength (kg/15 mm in width) | Breaking elongation (%) | Tearing strength (kg) | Bending Length (cm) | Density (g/cm$^3$) |
|---|---|---|---|---|---|---|
| Before drawing | 100 | 3.2 | 60 | 3.0 | 9.8 | 0.91 |
| After drawing | 68 | 3.0 | 10 | 3.2 | 4.5 | 0.63 |

EXAMPLES 2 to 4

In the same manner as described in Example 1, there was obtained various webs comprising filaments having various breaking elongations by regulating the drafting force of the air sucker. Various non-woven fabrics were produced from the webs in the same manner as described in Example 1 excepting that the drawing was carried out in the same ratio in the longitudinal and widthwise directions and the optimum draw ratio was determined on each product according to the kinds of the material.

Likewise, various non-woven fabrics were produced as Comparative Examples 1 to 6.

The properties of these products are shown in the following Table 2.

Table 2

| Example No. | Breaking elongation of filaments (%) | Ratio of elongation to the area | Basis weight ($g/m^2$) | Tensile strength (kg/15 mm in width) | Breaking elongation (%) | Tearing strength (kg) | Bending length (cm) | Density ($g/cm^3$) |
|---|---|---|---|---|---|---|---|---|
| 2 | 121 | 1.30 | 77 | 3.1 | 19 | 3.5 | 4.2 | 0.54 |
| 3 | 113 | 1.20 | 83 | 3.1 | 18 | 3.5 | 4.0 | 0.50 |
| 4 | 98 | 1.10 | 90 | 3.0 | 15 | 3.1 | 4.1 | 0.47 |
| Comp. Ex. 1 | 200 | 2.00 | 50 | 3.8 | 22 | 2.2 | 5.3 | 0.71 |
| Comp. Ex. 2 | 180 | 1.80 | 56 | 3.6 | 20 | 2.5 | 5.0 | 0.70 |
| Comp. Ex. 3 | 155 | 1.60 | 63 | 3.5 | 21 | 3.0 | 4.9 | 0.69 |
| Comp. Ex. 4 | 86 | 1.07 | 94 | 2.5 | 9 | 2.5 | 3.9 | 0.31 |
| Comp. Ex. 5 | 74 | Unable to be drawn | | | | | | |
| Comp. Ex. 6 | 69 | | | | | | | |

EXAMPLE 5

In the same manner as described in Example 1, there was obtained a web comprising filaments of polyethylene terephthalate having a breaking elongation of 130%. The web was subjected to the emboss calendering and then drawn uniaxially in the longitudinal draw ratio of 1.5 times at 80° C. The properties of the resulting non-woven fabric are shown in the following Table 3.

Table 3

| | Basis weight ($g/m^2$) | Tensile strength (kg/15 mm in width) | Breaking elongation (%) | Tearing strength (kg) | Bending length (cm) | Density ($g/cm^3$) |
|---|---|---|---|---|---|---|
| In the longitudinal direction of the sheet | 65 | 4.2 | 13 | 3.2 | 5.5 | 0.62 |
| In the widthwise direction of the sheet | | 2.3 | 65 | 3.8 | 6.4 | |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a non-woven fabric, which comprises drawing uniaxially or biaxially a non-woven sheet material comprising not less than 90% by weight of semi-drawn aromatic polyester fibers produced by melt spinning the polyester obtained from an aromatic dicarboxylic acid and an alkaline glycol wherein not less than 80% by mol of the component unit of the polyester is an ethylene terephthalate chain, said fibers having a breaking elongation of 80 to 150% wherein the fibers are crossed and intertwined with each other and are partially bonded at the crossing points, said drawing being carried out until the bonding of the fibers is partially broken or the fibers are partially cut.

2. The process according to claim 1 wherein the partial bonding of the fibers at the crossing points is carried out under heat and pressure at a temperature higher than the second-order transition temperature of the polyester and at least 60° C. lower than the melting point of the polyester.

3. The process according to claim 1, wherein the drawing is carried out at a draw ratio of 1.1 to 2.0 times.

4. The process according to claim 1, wherein the drawing is carried out at a temperature of at least 10° C. higher than the second-order transition temperature of the polyester fiber and at least 50° C. lower than the melting point of the polyester fiber.

5. A non-woven fabric having excellent draping properties and strength and having a handling similar to that of woven fabrics, which is produced by the process as set forth in claim 1.

* * * * *